US006983813B1

(12) United States Patent
Wright

(10) Patent No.: US 6,983,813 B1
(45) Date of Patent: Jan. 10, 2006

(54) REMOTE CONTROLLED AND MOTORIZED BABY WALKER

(76) Inventor: Brandi N. Wright, 0769 Frisco Creek Dr., Del Norte, CO (US) 81132

( * ) Notice: Subject to any disclaimer, the term of this patent is extended or adjusted under 35 U.S.C. 154(b) by 0 days.

(21) Appl. No.: 10/918,291

(22) Filed: Aug. 16, 2004

(51) Int. Cl.
*B60K 1/02* (2006.01)

(52) U.S. Cl. ..... 180/11; 180/15; 280/87.051

(58) Field of Classification Search ..... 280/87.051; 180/11, 15, 167, 166
See application file for complete search history.

(56) References Cited

U.S. PATENT DOCUMENTS

| | | | | |
|---|---|---|---|---|
| 126,452 | A | 5/1872 | Euell | |
| 658,126 | A | 9/1900 | Settlemyre | |
| 3,340,941 | A * | 9/1967 | Neu | 180/6.5 |
| 3,872,945 | A | 3/1975 | Hickman et al. | |
| 4,629,950 | A | 12/1986 | Ching | |
| 4,776,415 | A * | 10/1988 | Brice | 180/11 |
| 4,824,415 | A * | 4/1989 | Herbstler et al. | 446/276 |
| 4,941,497 | A | 7/1990 | Prather et al. | |
| RE33,675 | E * | 8/1991 | Young | 180/167 |
| 5,713,586 | A * | 2/1998 | Haller | 280/87.051 |
| 5,865,450 | A * | 2/1999 | Ulrich | 280/87.051 |
| 6,360,836 | B1 * | 3/2002 | Milano et al. | 180/65.6 |
| 6,656,010 | B1 * | 12/2003 | Bienz et al. | 446/431 |
| 6,755,265 | B2 * | 6/2004 | Huntsberger et al. | 180/65.1 |
| 6,832,770 | B1 * | 12/2004 | Wright-Ott et al. | 280/87.041 |

FOREIGN PATENT DOCUMENTS

| | | | |
|---|---|---|---|
| GB | 2250962 | A * | 6/1992 |

* cited by examiner

*Primary Examiner*—J Allen Shriver
(74) *Attorney, Agent, or Firm*—Donald R. Schoonover

(57) ABSTRACT

A baby walker includes motor-driven wheels with the motor being connected to sensors on the walker and to a remote control system. The sensors on the walker prevent the walker from colliding with objects, such as furniture or the like, and the remote control system includes hand-held or belt-worn controls that are in the possession of an adult so the adult can exert control over movement of the walker. A seat is also included so small children can be placed in the walker if desired.

3 Claims, 1 Drawing Sheet

REMOTE CONTROLLED AND MOTORIZED BABY WALKER

BACKGROUND OF THE INVENTION

1. Field of the Invention

The present invention relates to the general art of baby walkers, and to the particular field of baby walkers having accessories.

2. Discussion of the Related Art

Many parents and adults try to keep a baby entertained by placing the infant in a walker or a baby bouncer. The prior art walkers of which the inventor is aware generally have a frame, which surrounds the baby, and wheels. The baby supports itself on the frame and movement of the walker is produced when the baby executes a walking motion. The walker thus supports the infant while the infant learns to walk.

These walkers have been quite successful but have several disadvantages. For example, unless the infant is under constant supervision, the infant may move the walker in a manner that causes a collision with another object, such as furniture or the like. Still further, unless the movement of the walker is monitored, the infant may move the walker into an area of danger, such as near a stairway or the like.

Therefore, there is a need for a baby walker that can be controlled by an adult.

Some infants are not strong enough to move a walker and others may need instruction on use of a walker. These infants may simply sit in the walker until the adult moves the walker. This defeats some of the purpose of the walker.

Therefore, there is a need for a motorized walker.

As mentioned above, some infants may move a walker in a manner that causes a collision with another object or on a course that may lead to danger.

Therefore, there is a need for a motorized walker that includes sensors that are connected to the motor to control movement of the walker.

Some infants may be very young or small when a parent or adult wishes to place them in a walker. These infants may need support to remain safely in the walker. Also, even if the infant is large enough to comfortably stay in the walker, some parents may feel safer if the infant is somehow comfortably restrained in the walker.

Therefore, there is a need for a motorized walker that is adaptable for use with a seat so the walker is versatile.

PRINCIPAL OBJECTS OF THE INVENTION

It is a main object of the present invention to provide a baby walker that can be controlled by an adult.

It is another object of the present invention to provide a motorized walker.

It is another object of the present invention to provide a motorized walker that includes sensors that are connected to the motor to control movement of the walker.

It is another object of the present invention to provide a motorized walker that is adaptable for use with a seat so the walker is versatile.

It is another object of the present invention to provide a motorized walker that is adaptable for use with a plurality of different remote control units.

SUMMARY OF THE INVENTION

These, and other, objects are achieved by a baby walker that includes motors which are remote controlled and which are also controlled by sensors on the walker. The walker also includes a seat that can be used to support small children. The motors move wheels on the walker to assist the infant in moving the walker, but the remote controls and sensors control movement of the walker so the infant cannot move the walker into a collision or into a dangerous situation without the walker or the person supervising the child being able to exert some control over the movement of the walker to prevent the walker and child from moving into such an undesirable situation.

Using the walker embodying the present invention will permit a baby walker to be controlled by an adult whereby the baby is not likely to move into a dangerous situation. The walker embodying the present invention also includes sensors on the walker that can control the motor to prevent the baby from colliding with furniture or other objects. The seat makes the walker embodying the present invention versatile so small children can be placed in the walker and entertained. Various remote control units can be used in connection with the walker embodying the present invention to further improve the versatility of the walker.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in a remote controlled and motorized baby walker 10 that achieves the above-stated objectives.

Figure 1:
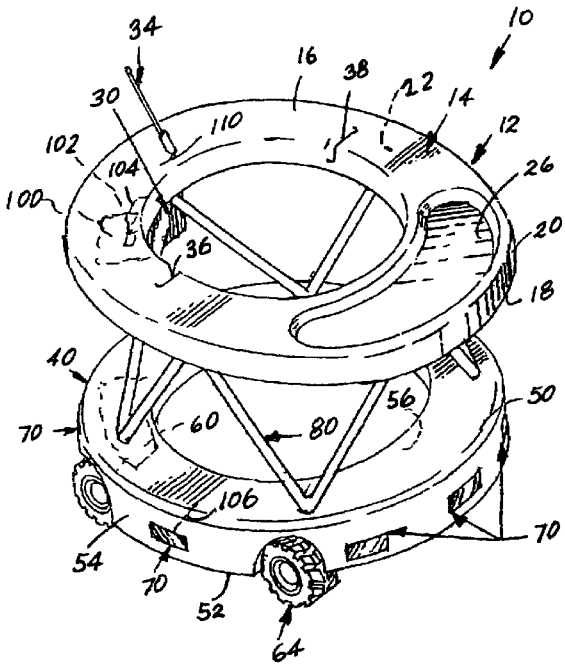
FIG. 1 is a perspective view of a motorized and controlled baby walker embodying the present invention.
Figure 2:
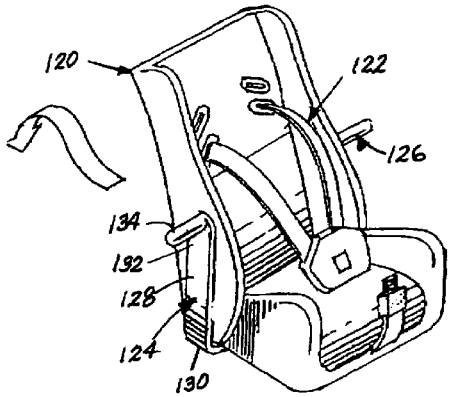
FIG. 2 is a perspective view of a seat that can be used in conjunction with the motorized baby walker shown in FIG. 1.

Walker 10 comprises a baby support unit 12 which supports the baby. Support unit 12 includes a first support frame 14 which is a top frame when baby support unit 12 is in use, with a use orientation being shown in FIG. 1. First support frame 14 is annular in shape and includes a first surface 16 that is a top surface when baby support frame 12 is in use, a second surface 18 that is a bottom surface when baby support frame 14 is in use, and a circular side wall 20 that connect first surface 16 and second surface 18.

First support frame 14 is hollow and has an internal volume 22 defined between first surface 16, second surface 18, and side wall 20.

A tray area 26 is defined in first surface 16 in position to be in front of a baby when that baby is supported in unit 12.

A rechargeable battery pack 30 is mounted on second surface 18. An antenna 34 is mounted on first surface 16. Two projection element-accommodating areas 36 and 38 are defined in first surface 16 for a purpose that will be understood from the teaching of this disclosure.

A second support frame 40 is a bottom frame when baby support unit 12 is in use. Second support frame 40 is annular in shape and includes a first surface 50 that is a top surface when baby support frame 12 is in use, a second surface 52 that is a bottom surface when baby support frame 12 is in use, and a circular side wall 54 that connects first surface 50 and second surface 52.

An internal volume 56 is defined between first surface 50, second surface 52, and side wall 54.

A motor 60 is located in internal volume 56 of second support frame 40. Motor 60 is an electric motor.

A plurality of wheels, such as wheel 64, are mounted on second support frame 40 and are operatively connected to motor 60 to be driven thereby. The exact details of the connection between the wheels 64 and the motor 60 are not important to the present invention and thus will not be discussed as those skilled in the art will understand how to connect the wheels 64 and the motor 60 based on the teaching of this disclosure.

A plurality of sensors 70 are mounted in side wall 54 of second support frame 40. Sensors 70 are proximity sensors of the type known to those skilled in the art.

A frame support unit 80 connects second surface 18 of first support frame 14 to first surface 50 of second support frame 40.

Figure 4:
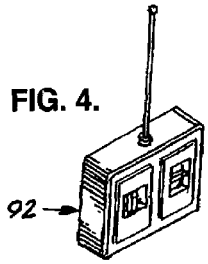
FIG. 4 is a belt attached remote control unit used in connection with the walker shown in FIG. 1.
Figure 3:
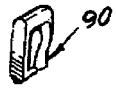
FIG. 3 is a perspective view of a hand held remote control unit used in connection with the walker shown in FIG. 1.

A remote control unit is adapted to be located remotely from baby support unit 12 and can be mounted on a user's belt, such as indicated in FIG. 3 for remote control unit 90, or hand held as indicated for remote control unit 92 shown in FIG. 4. The remote control units are adapted to communicate with antenna 34 on baby support unit 12 via wireless communications such as are well known to those skilled in the art. The exact details of the communication between the remote control unit 90, 92 and the baby support unit 12 are not important to the present invention and thus will not be discussed in detail.

A motor control circuit 100 is located in first support frame 14 and includes an on/off control element 102 electrically connecting battery pack 30 to motor 60 via leads, such as lead 104.

Motor control circuit 100 further includes means, such as lead 106, which electrically connects the sensors 70 to on/off control element 102, and means, such as lead 110, which electrically connect antenna 34 to on/off control element 102.

Operation of the controlled unit 12 will be understood from the teaching of this disclosure. For example, an adult can cause the unit to move or stop by using the remote control unit 90, 92; however, if the unit 12 comes in close proximity to an obstacle or the like, the proximity sensors 70 will shut the motor 60 off and possibly apply a brake element to ensure that the unit stops.

If a small baby is to be placed in unit 12, use is made of a baby support seat 120 that is sized and adapted to be removably supported in baby support unit 12. Baby support seat 120 includes a seat belt 122 and two support elements 124 and 126. Support elements 124 and 126 are identical, and each includes a support arm 128 which has a proximal end 130 fixed to baby support seat 120 and a distal end 132. A projection element 134 is located on distal end 132 and is sized and shaped to be accommodated in one of the projection element-accommodating areas 36 or 38 defined in first support frame 14.

Seat 120 is removably mounted on unit 14 and the baby can be strapped into seat 120. Seat 120 can swing on unit 14 so the baby can move its feet and move about in the unit while still being securely held in the unit.

It is to be understood that while certain forms of the present invention have been illustrated and described herein, it is not to be limited to the specific forms or arrangements of parts described and shown.

What is claimed is:

1. A remote controlled and motorized baby walker comprising:

(a) a baby support unit which includes (1) a first support frame which is a top frame when said baby support unit is in use, the first support frame being annular in shape and including (A) a first surface that is a top surface when said baby support frame is in use, (B) a second surface that is a bottom surface when said baby support frame is in use, (C) a circular side wall connecting the first surface of the first support frame to the second surface of the first support frame, (D) an internal volume defined between the first surface of the first support frame, the second surface of the first support frame and the side wall of the first support frame, (E) a tray area defined in the first surface of the first support frame, (F) a rechargeable battery pack mounted on the second surface of the first support frame, (G) an antenna mounted on the first surface of the first support frame, and (H) two projection element-accommodating areas defined in the first surface of the first support frame;

(2) a second support frame which is a bottom frame when said baby support unit is in use, the second support frame being annular in shape and including (A) a first surface that is a top surface when said baby support frame is in use, (B) a second surface that is a bottom surface when said baby support frame is in use, (C) a circular side wall connecting the first surface of the second support frame to the second surface of the second support frame, (D) an internal volume defined between the first surface of the second support frame, the second surface of the second support frame and the side wall of the second support frame, (E) a motor located in the internal volume of the second support frame, (F) a plurality of wheels mounted on the second support frame and operatively connected to the motor to be driven thereby, and (G) a plurality of sensors mounted in the side wall of the second support frame;

(b) a frame support unit connecting the second surface of the first support frame to the first surface of the second support frame;

(c) a remote control unit adapted to be located remotely from said baby support unit, said remote control unit being adapted to communicate with the antenna on said baby support unit;

(d) a motor control circuit located in the first support frame and including (1) an on/off control element electrically connecting the battery pack to the motor, (2) means electrically connecting the sensors to the on/off control element, and (3) means electrically connecting the antenna to the on/off control element; and (e) a baby support seat that is sized and adapted to be removably supported in said baby support unit, said baby support seat including (1) a seat belt, and (2) two support elements each of which includes a support arm having a proximal end fixed to said baby support seat and a distal end and a projection element on the distal end which is sized and shaped to be accommodated in one of the projection element-accommodating areas defined in the first support frame.

2. The remote controlled and motorized baby walker as described in claim 1 wherein said remote control unit includes a hand-held unit.

3. The remote controlled and motorized baby walker as described in claim 2 wherein said remote control unit includes a belt-supported unit.

* * * * *